US005121101A

United States Patent [19]

Jakubowski et al.

[11] Patent Number: 5,121,101

[45] Date of Patent: Jun. 9, 1992

[54] APPARATUS AND METHOD FOR A SMOKE ALARM DEVICE WITH INTEGRATED TESTING CIRCUITS

[76] Inventors: Peter J. Jakubowski, 18072 Lakepoint La., Huntington Beach, Calif. 92647; Randolph D. Pearce, 3417 N. 28th St., Phoenix, Ariz. 85016

[21] Appl. No.: 418,651

[22] Filed: Oct. 10, 1989

[51] Int. Cl.[5] ..... G08B 21/00

[52] U.S. Cl. ..... 340/515; 340/628; 340/514

[58] Field of Search ..... 340/514, 515, 584, 588–590, 340/593, 599, 628

[56] References Cited

U.S. PATENT DOCUMENTS

| | | | |
|---|---|---|---|
| 3,882,477 | 5/1975 | Mueller | 340/515 |
| 4,088,986 | 5/1978 | Boucher | 340/628 |
| 4,595,914 | 6/1986 | Siegel | 340/629 |
| 4,965,556 | 10/1990 | Brodecki et al. | 340/628 |

*Primary Examiner*—Edward L. Coles, Sr.
*Assistant Examiner*—Jill Jackson
*Attorney, Agent, or Firm*—William W. Holloway

[57] ABSTRACT

Apparatus for providing integrated test circuits for a smoke detector is disclosed. The smoke detector operates such that products of combustion such as smoke and carbon monoxide cause the resistance across a sensor element to be lowered. The lowered resistance of the sensor element, in normal operation, causes a change in an associated voltage level. When the change in the associated voltage level is sufficiently large, the change is detected resulting in the generation of an alarm signal. In the present invention, a switch or button causes a circuit variation that results in a voltage level change similar to that attained when the voltage across the sensor changes as a result of the introduction of the products of combustion. Activation of the switch or button results in a generation of the alarm signal and tests the operational status of the smoke detector. A multiplicity of embodiments of the present invention are illustrated.

18 Claims, 3 Drawing Sheets

APPARATUS AND METHOD FOR A SMOKE ALARM DEVICE WITH INTEGRATED TESTING CIRCUITS

BACKGROUND OF THE INVENTION

1. Field of the Invention

This invention relates generally to the detection of the products of combustion and, more particularly, to the detection of the toxic gaseous products of combustion.

2. Description of the Related Art

In recent years, publicity has been given to devices which indicate the presence of combustion. These devices have been and are being widely deployed in private and commercial buildings to alert residences of a potentially dangerous situation. In order to insure that the devices are operational, a requirement has been imposed that devices must be capable of being tested, in situ, to insure availability when needed.

In a sense, the information provided with respect to the solid particle detectors of particles of combustion has been deceptive. The detectors generally referred to as smoke detectors are, in fact, solid particle detectors. The mechanisms upon which the solid particle detectors operate are typically radiation induced or photo-induced conduction. When particulate matter is introduced into the chamber of the solid particle detector, the particulate matter causes ionization of the air in the chamber. The ionization of the air causes a decrease in voltage in the sensing chamber, the decrease in voltage, when sufficiently large, resulting in activation of an alarm device.

The solid particle detectors suffer from two major disadvantages. First, the material detected is typically more prevalent when active and complete combustion is taking place, and not during a smoldering stage (i.e., with incomplete combustion). Second, the principal harmful ingredient from complete or incomplete combustion is carbon monoxide, a gas which is not detected by the solid particle ionization or photo-electric detectors. In the test procedure of these devices, the voltage across the chamber is lowered (without becoming zero) to determine if the alarm device is activated when voltage is decreased a predetermined amount.

Recently, a true smoke detector, identified as the Figaro Gas Sensor TGS 813 or the improved TGS 203 (having two heater elements to increase the sensitivity to carbon monoxide) has been distributed in the United States by the Figaro USA, INC of Wilmette, Ill. This device is filling the need for a device that is able to detect gases and, more particularly, to detect carbon monoxide. The sensor element of the smoke detector is comprised of a sintered bulk semiconductor consisting principally of tin oxide ($SnO_2$). When an appropriate gas is introduced into the smoke detector, the resistance across the smoke detector falls. However, the smoke detector unit has not been provided with the test circuits that would permit on location testing, the test circuits that would make the unit acceptable by Underwriters Laboratory requirements for widespread (including residential) applications.

A need has therefore been felt for apparatus and an associated method which simulate the introduction of an appropriate gas into the smoke sensor to determine if the test circuits, including an associated alarm device, are functional.

FEATURES OF THE INVENTION

It is an object of the present invention to provide an improved detecting unit for detection the products of including smoke (i.e., carbon monoxide).

It is a feature of the present invention to provide an improved detection unit for detecting smoke (carbon monoxide).

It is another feature of the present invention to provide a smoke detector with a test circuit, the test circuit determining when the smoke detector and an associated alarm are operational.

SUMMARY OF THE INVENTION

The aforementioned and other features are attained, according to the present invention, by providing the smoke detector unit with circuits that affect the smoke detector unit sensor element in a manner similar to the introduction of smoke into the detector chamber of the sensor element. In this manner, the smoke detector unit will be considered functional when conditions simulating the introduction of smoke into the detector chamber result in activation of the alarm. In particular, the introduction of smoke into the detector chamber lowers the resistance across the sensor element and results in a change in voltage across the sensor element. The present invention permits an operator by throwing of a switch or by pressing a button, to cause a voltage change in the smoke detector that is similar to the change when smoke is introduced into the detector chamber of the sensor element.

These and other features of the invention will be understood upon reading of the following description along with the drawings.

DESCRIPTION OF THE PREFERRED EMBODIMENT

1. Detailed Description of the Figures

Figure 1:
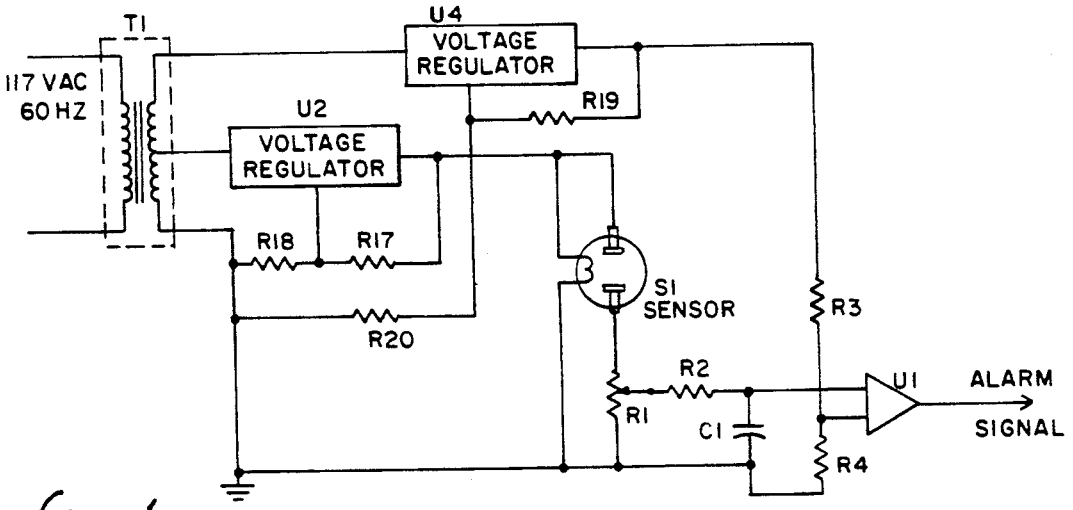
FIG. 1 is a schematic diagram of the smoke detector without the test circuits.

Referring now to FIG. 1, the schematic diagram of the smoke detector unit without the test circuits is shown. The input terminals of transformer T1 are coupled to the power lines while a first output terminal of the transformer T1 is coupled to an input terminal of voltage regulator U4. The output terminal of voltage regulator U4 is coupled through resistor R19 to the reference terminal of voltage regulator U4. The reference terminal of voltage regulator U4 is coupled through resistor R20 to the common terminal. The output terminal of voltage regulator U4 is coupled through resistor R3 to a first input terminal of comparator U1. A second output terminal of transformer T1, which is also the common terminal, is coupled to a first terminal of the heater element of sensor element S1, to a first terminal of rheostat R1, through capacitor C1 to a second input terminal of comparator U1, and through resistor R4 to the first terminal of comparator U1. A second terminal of rheostat R1 is coupled to first sensing terminal of sensor element S1, while the variable terminal of rheostat R1 is coupled through resistor R2 to the second input terminal of comparator U1. A second sensing terminal of sensor element S1 and a second heating terminal of sensor S1 are coupled to an output terminal of voltage regulator U2. The input terminal of voltage regulator U2 is coupled to a third output terminal of transformer T1. The output terminal of voltage regulator U2 is coupled through resistor R17 to a reference terminal of voltage regulator U2. The reference terminal of voltage regulator is coupled through resistor R18 to the common terminal. The output terminal of comparator U1 provides the alarm signal.

Figure 2:
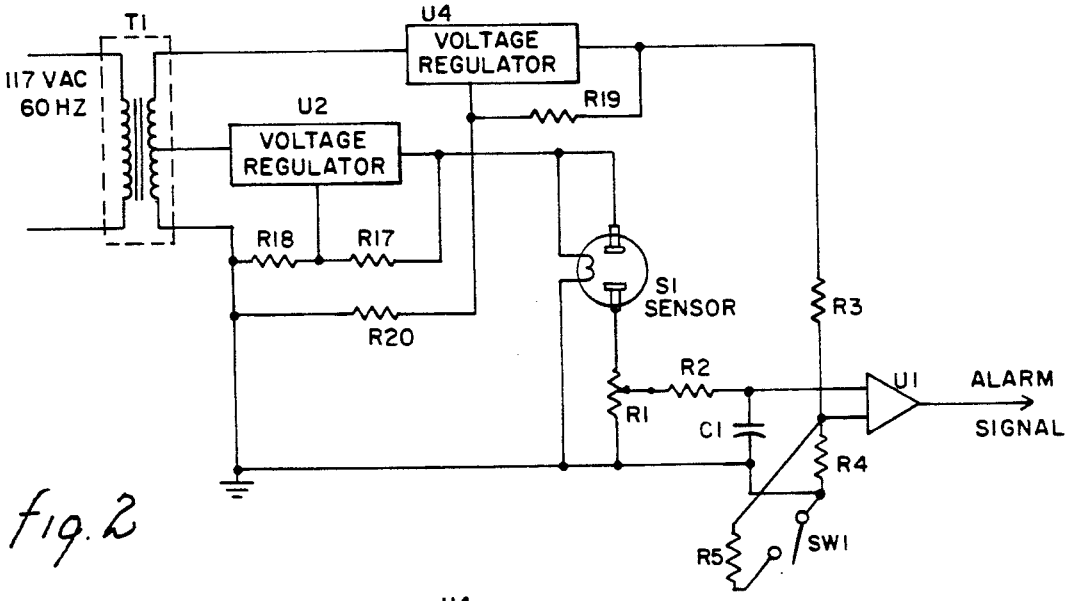
FIG. 2 is a schematic diagram of a smoke detector unit of the present invention including the smoke detector and the test circuits according to a first embodiment.

Referring now to FIG. 2, the smoke detector unit shown in FIG. 1 is repeated with the addition of test circuit elements. The test circuit elements include a resistor R5 coupled in series with normally open switch SW1, the series circuit of the resistor R5 and the switch SW1 being coupled in parallel with resistor R4.

Figure 3:
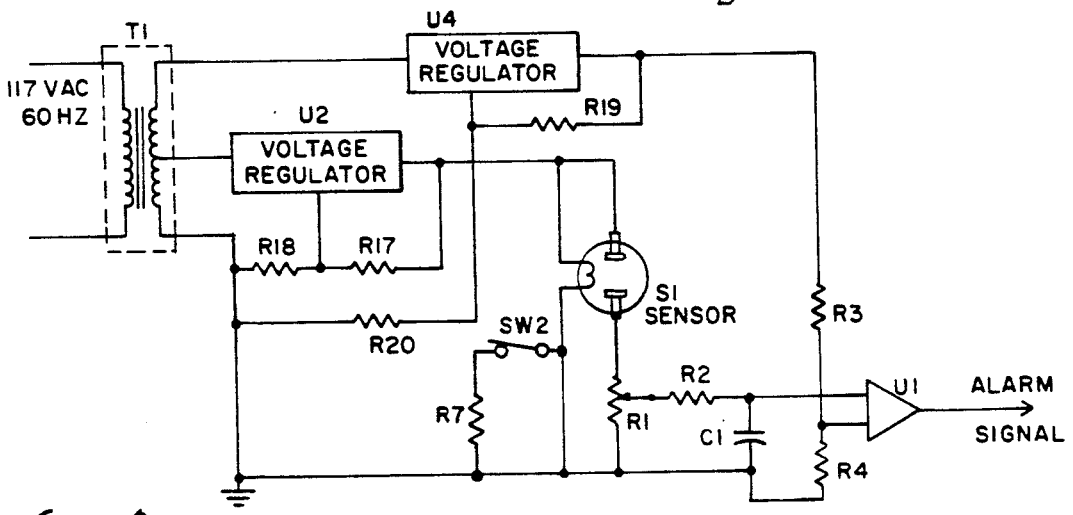
FIG. 3 is a schematic diagram of the smoke detector unit of the present invention including the smoke detector and the test circuits according to a second embodiment.

Referring now to FIG. 3, the smoke detector unit of FIG. 1 is shown with a second embodiment of the test circuit elements of the present invention. The test circuit elements include resistor R7 coupled in series with normally closed switch SW2, the series combination of resistor R7 and switch SW2 being coupled in parallel with rheostat R1.

Figure 4:
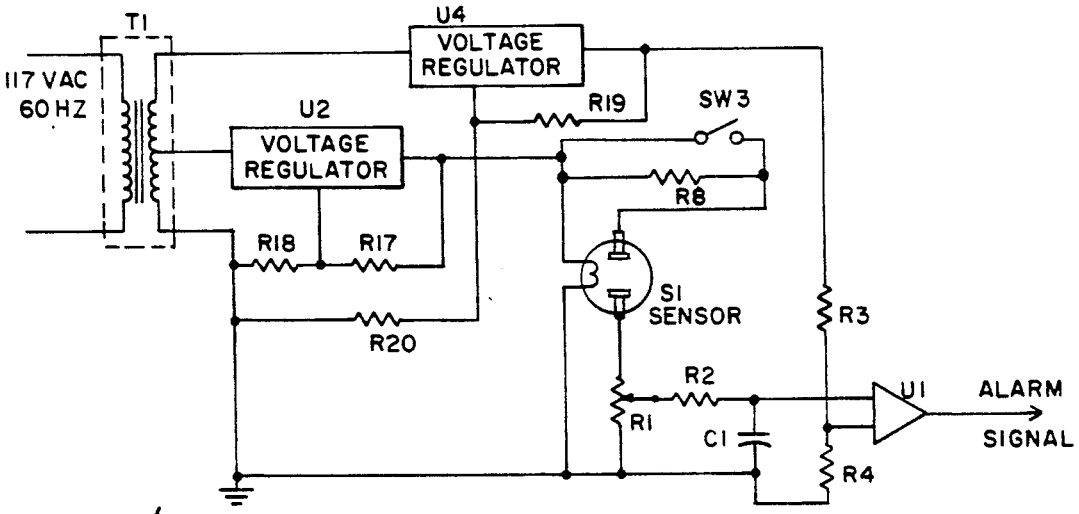
FIG. 4 is a schematic diagram of the smoke detector unit according to a third embodiment of the present invention.

Referring next to FIG. 4, the smoke detector unit of FIG. 1 is shown with a third embodiment of the test circuit elements according to the present invention. A resistor R8 and a normally open switch SW3 are coupled in parallel, the parallel combination of switch SW3 and resistor R8 being coupled between the second sensing terminal of sensor element S1 and the output terminal of voltage regulator U2.

Figure 5:
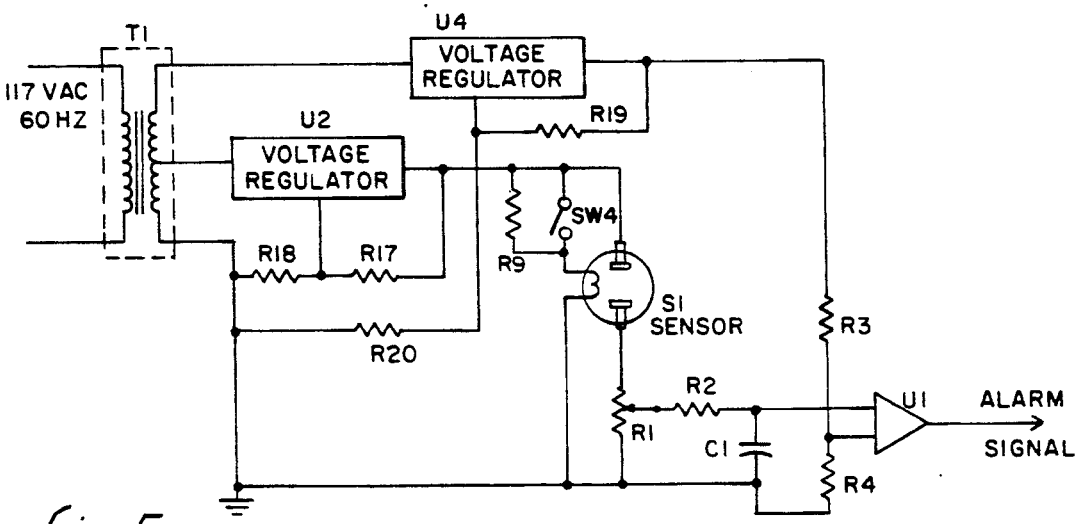
FIG. 5 is a schematic diagram of the smoke detector unit according to a fourth embodiment of the present invention.

Referring next to FIG. 5, the smoke detector unit of Fig. is shown with test circuit elements according to the fourth embodiment of the present invention. The test circuit elements, resistor R9 and normally open switch SW4, are coupled in parallel, the parallel combination of resistor R9 and switch SW4 being coupled between the second heater terminal of sensor S1 and the output terminal of voltage regulator U2.

Figure 6:
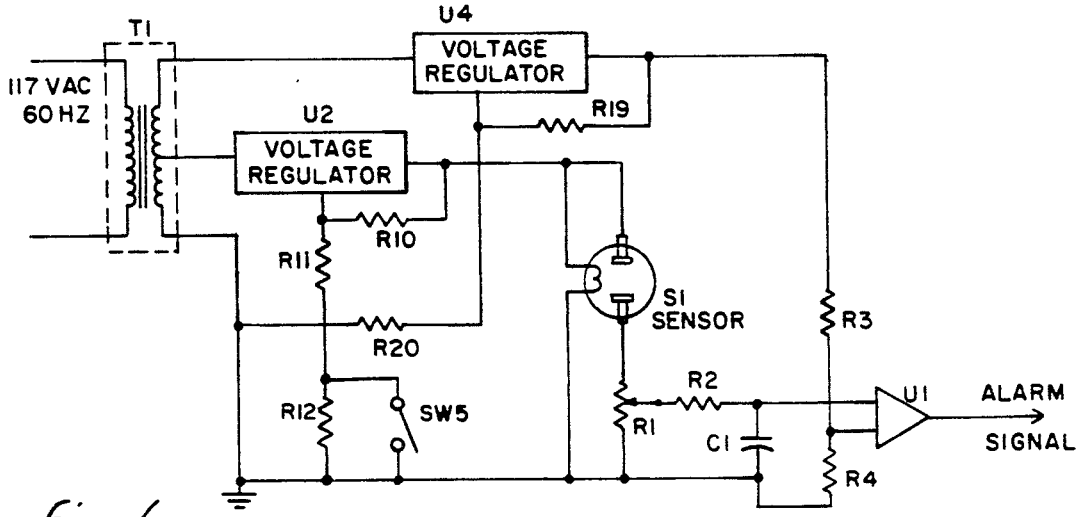
FIG. 6 a schematic diagram of the smoke detector unit according to a fifth embodiment of the present invention.

Referring next to FIG. 6, the smoke detector unit of FIG. 1 is shown along with test circuit elements comprising a fifth embodiment of the present invention. Voltage regulator U2 has resistor R10 coupled between the output terminal the voltage regulator U2 and the reference terminal of voltage regulator U2. The reference terminal of voltage regulator U2 is coupled through resistors R11 and R12, resistors R11 and R12 being coupled in series, to the common terminal. Normally open switch SW5 is coupled in parallel with resistor R12.

Figure 7:
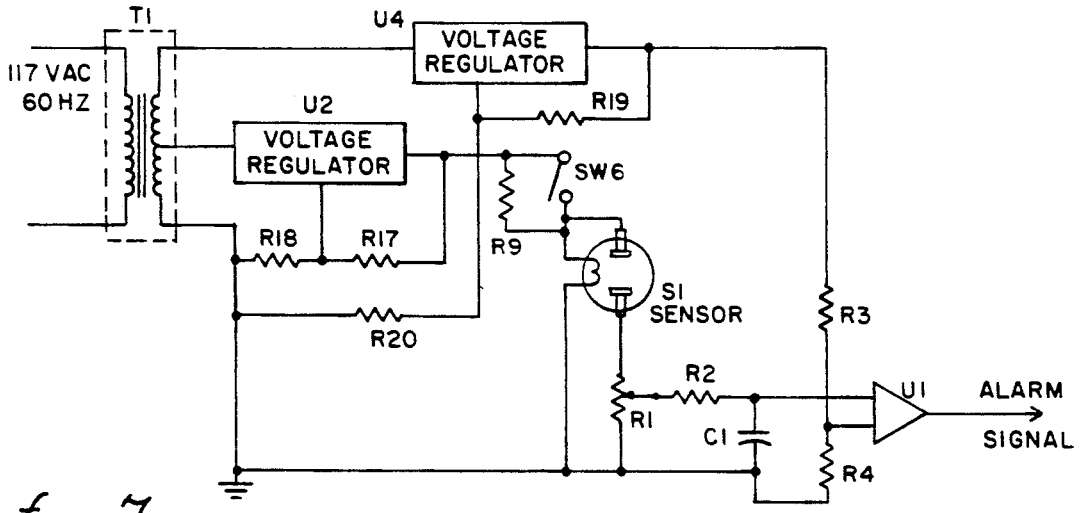
FIG. 7 is a schematic diagram of the smoke detector unit according to a sixth embodiment of the present invention.

Referring next to FIG. 7, the smoke detector of FIG. 1 is shown along with test circuit elements according to the sixth embodiment of the present invention. The test circuit elements include resistor R9 coupled in parallel with normally open switch SW6, the parallel combination of resistor R9 and switch SW6 coupled between the output terminal of voltage regulator U2 and the second terminal of the heater element of sensor element S1 and the second sensing terminal of sensor S1, the second terminal of the heating element of sensor element S1 and the second terminal of the second sensing element of sensor element S1 being coupled together.

Figure 8:
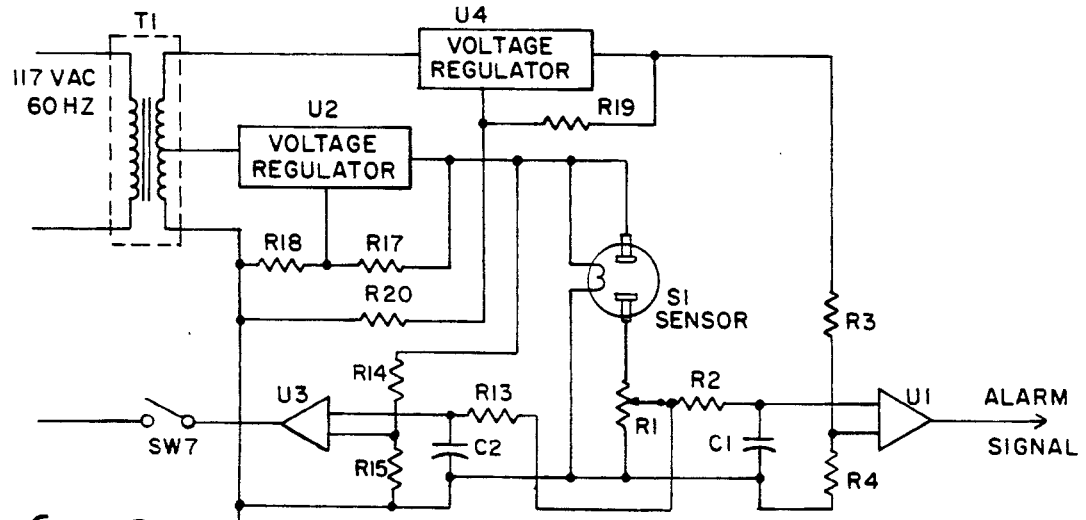
FIG. 8 is a schematic diagram of the smoke detector unit according to a seventh embodiment of the present invention.

Referring to FIG. 8, the smoke detector of FIG. 1 is shown along with the test circuit elements according to the seventh embodiment of the present invention. The test circuit elements include: a second comparator U3; a resistor R14 coupled between an output terminal of voltage regulator U2 and a first terminal of second comparator U3; resistor R15 coupled between the first terminal of comparator U3 and the second output terminal of transformer T1; capacitor C2 coupled between a second terminal of second comparator U3 and the second output terminal of transformer T1; and resistor R13 coupled between the variable terminal of rheostat R1 and the second input terminal of second comparator U3. The output terminal of second comparator U3 is coupled to one terminal of normally open switch SW7.

Figure 9:
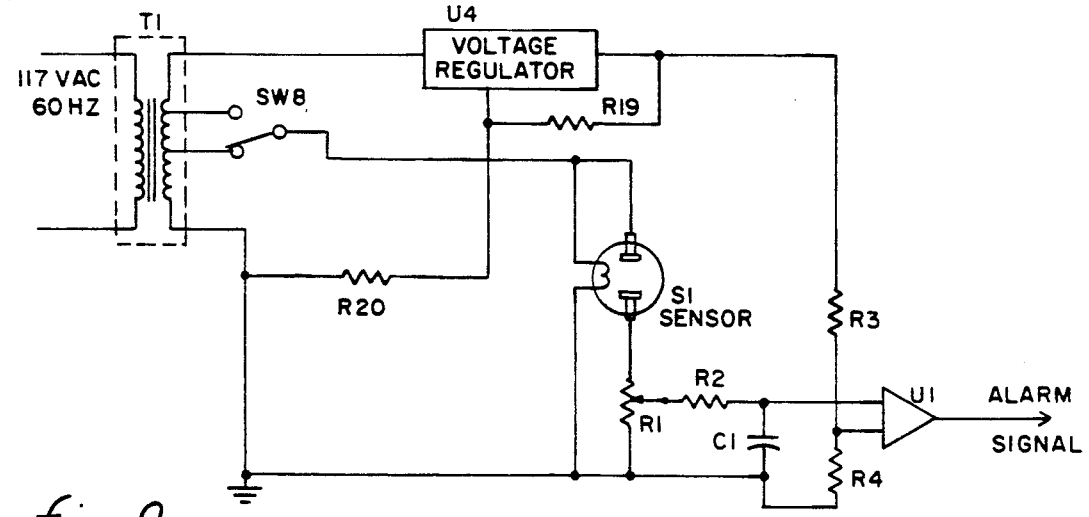
FIG. 9 is a schematic diagram of the smoke detector unit according to a eighth embodiment of the present invention.

Referring to FIG. 9, the smoke detector of FIG. 1 is shown along with the test circuit elements of the eighth embodiment of the present invention. The voltage regulator U2, along with associated resistors R17 and R18 of FIG. 1 has been replaced by a two position switch SW8. The second terminal of the heating element and the second sensing terminal of the sensor element S1 are coupled to one terminal of switch SW8. The second and third terminals of switch SW8 select one of two output terminals of transformer T1.

2. Operation of the Preferred Embodiment

Referring again to FIG. 1, the operation of the smoke detector can be understood in the following manner. The voltage regulator U4 applies a voltage level to the first input terminal of comparator U1. The output voltage of voltage regulator U4 is determined by the voltage between the first and second output terminals of transformer T1 and the ratio of resistor R19 to resistor R20. The resistors R3 and R4 provide a resistor dividing network that applies a predetermined ratio of the output voltage of voltage regulator U4 to the first input terminal of comparator U1. The output voltage of voltage regulator U2 is determined by the voltage of the transformer T1 between the second and third terminals and the ratio of resistor R17 and resistor R18. The sensor element S1 has a resistance RS. The voltage applied to the second input terminal of comparator U1 is determined by the resistor RS, the rheostat resistor R1, and the position of the variable terminal of the rheostat R1. The voltage at the second terminal of comparator U1 is chosen to be less than the voltage applied to the first terminal of comparator U1, the difference in voltage between the two terminals determining the sensitivity of the smoke detector and being controlled by the position of the variable terminal of rheostat R1. The voltage applied to said second terminal is less than the reference voltage when no products of combustion are detected by the sensor element S1. The voltage applied to said second terminal is greater than the reference voltage when products of combustion detected by the sensor element S1 exceed a predetermined amount. The resistor R2 and the capacitor C1 form a high frequency filter to minimize the effects of the signal pick-up and signal spikes.

When the carbon monoxide gas enters the sensor S1, the resistance RS of the sensor element S1 decreases. Because the voltage at the output terminal of voltage regulator U2 is constant, then, the decrease in the resistance RS causes the voltage at the second input terminal of comparator U1 to increase. When the voltage of the second input terminal of comparator U1 becomes larger than the voltage applied to the first terminal of comparator U1, then the output voltage of the comparator U1 changes state and an alarm signal is generated.

Referring again to FIG. 2, when the switch SW1 is closed, resistor R5 is placed in parallel with resistor R4. The new combination has a lowered resistance between the first input terminal of comparator U1, lowering the voltage with respect to the second input terminal. When the circuit and voltage values are correctly chosen, the voltage applied to the first input terminal of the comparator U1 will fall below the voltage level of the second input terminal of the comparator U1, causing the comparator U1 to change state and providing an alarm signal for as long as the resistor R5 is coupled into the circuit.

Referring to FIG. 3, the resistor R7 is normally in the smoke detector circuit. When switch SW2 is activated, the resistor R7 is removed from the circuit. Therefore, the resistance between the sensor element and the common terminal is increased, causing the voltage across resistor R1 to increase and raising the voltage level applied to the second input terminal of comparator U1. When the circuit components and voltages are properly selected, the voltage level applied to the first input terminal will rise above the voltage level applied to the second input terminal of comparator U1 resulting in an alarm signal until resistor R7 is reinserted in the circuit.

Referring again to FIG. 4, when switch SW3 is closed, the resistor R8 is shorted out, i.e., removed from the circuit. The current through rheostat R1 will increase, causing the voltage level applied to the second input terminal of comparator U1 to be increased. When the increase in voltage is sufficiently large, the comparator U1 will change state and an alarm signal will be generated until switch SW3 is opened and the resistor R8 reintroduced in the circuit.

Referring again to FIG. 5, the resistor R9 is typically included in series with the heater element(s) of the sensor element S1. When switch SW4 is closed, the resistor R9 is shorted out, i.e., is removed from the circuit. When the resistor R9 is no longer in series with the heater element of sensor element S1, the voltage across the heater will increase. The increased heat from the sensor heating element will cause the voltage across the sensor element S1 to decrease, the voltage across rheostat R1 to rise, and the voltage applied to the second input terminal of comparator U1 to rise. When the circuit component values and voltage levels are selected properly, the output terminal of the comparator U1 will provide an alarm signal.

Referring again to FIG. 6, the ratio of resistor R10 to resistors R11 and R12 determine the voltage at the output terminal of voltage regulator U2. When the resistor R12 is removed from the circuit by closing switch SW5 and providing a short circuit across resistor R12, the current through the sensor element S1 will increase, both because of the increase voltage across sensor element S1 and because the increased heater current will lower the resistance of sensor element S1. The increase in current, when the circuit parameters are correctly chosen, will activate the alarm signal at the output terminal of comparator U1.

Referring again to FIG. 7, the resistor R9 is normally in the circuit in series with the sensor element S1. When switch SW6 is closed, the resistor R9 is removed from the circuit by providing a short circuit across resistor R9. The voltage will increase across the sensor element S1 and the rheostat R1. For the reasons described with reference to FIG. 6, correctly chosen circuit parameters will provide an alarm signal at the output terminals of comparator U1 as long as the resistor R9 is removed from the circuit.

Referring again to FIG. 8, the comparator U3 has a reference voltage set as a ratio of the voltage applied across the sensor element S1 and the rheostat R1. The voltage applied to the first terminal of comparator U3 is selected to be less than the voltage typically applied to the second input terminal of comparator U3. When the voltage applied to the second input terminal of U2 falls below the voltage applied to the first input terminal of comparator U3, an alarm signal will sound. This condition will occur when the heater elements have an open circuit (and the resistance across the sensor S1 increases), or when the sensing elements of the sensor element S1 have a short circuit condition. The switch SW7 permits these parameters to be tested during a manual test, however, it will be clear that this test could be performed continuously to identify the undesired condition in the sensor element S1. The circuit of FIG. 8 can be used in conjunction with the other test circuit herein described.

Referring once again to FIG. 9, the voltage level applied to the first input terminal of comparator U1 is larger than the value of the peak alternating voltage when switch SW8 coupled the sensor element S1 in the position shown. When switch SW8 is coupled to the higher voltage position (relative to the common terminal), the voltage across the resistor and rheostat R1 will increase. When the parameters are selected properly, then the second input terminal will be higher than the first input terminal for a period during each cycle, resulting in the generation of an alarm signal.

The foregoing description is included to illustrate the operation of the preferred embodiment and is not meant to limit the scope of the invention. The scope of the invention is to be limited only by the following claims. From the foregoing description, many variations will be apparent to those skilled in the art that would yet be encompassed by the spirit and scope of the invention.

What is claimed is:

1. A smoke detector unit including testing apparatus, said smoke detector unit comprising:

a first voltage regulator providing a first regulated voltage;

a sensing component responsive to products of combustion, a sensing component resistance decreasing when products of combustion are detected by said sensing component;

resistor means coupled in series with said sensing component, said resistor means having a resistor terminal, said resistor means and said sensing component coupled to said first voltage regulator;

a second voltage regulator providing a reference voltage;

comparator means for providing an alarm signal at an output terminal of said comparator means when a voltage applied to a second terminal of said comparator means is greater than a detector voltage applied to a first terminal of said comparator means, said reference voltage being applied to said first terminal, said second terminal of said comparator means being coupled to said resistor terminal, wherein said detector voltage applied to said second terminal is less than said reference voltage when products of combustion detected by said sensing component result i a sensing component resistance less than a predetermined value and wherein said detector voltage applied to said second terminal is greater than said reference voltage when products of combustion detected by said sensing component result in a sensing component resistance greater than said predetermined value; and switch means for causing said voltage applied to said second terminal to be greater than said reference voltage when said switch means is activated;

wherein said sensing component includes a heating element, said heating element and said switch means coupled in series and having said first regulated voltage applied thereto, said switch means having a bias resistive component and a switch, said bias resistive component coupled in parallel with said switch, activation of said switch causing a short circuit across said bias resistive component.

2. The smoke detector unit of claim 1 wherein said bias resistive component is a resistor.

3. A smoke detector unit including testing apparatus, said smoke detector unit comprising:

a first voltage regulator providing a first regulated voltage;

a sensing component responsive to products of combustion, a sensing component resistance decreasing when products of combustion are detected by said sensing component;

resistor means coupled in series with said sensing component, said resistor means having a resistor terminal, said resistor means and said sensing component coupled to said first voltage regulator;

a second voltage regulator providing a reference voltage;

comparator means for providing an alarm signal at an output terminal of said comparator means when a voltage applied to a second terminal of said comparator means is greater than a detector voltage applied to a first terminal of said comparator means, said reference voltage being applied to said first terminal, said second terminal of said comparator means being coupled to said resistor terminal, wherein said detector voltage applied to said second terminal is less than said reference voltage when products of combustion detected by said sensing component result in a sensing component resistance less than a predetermined value and wherein said detector voltage applied to said second terminal is greater than said reference voltage when products of combustion detected by said sensing component result in a sensing component resistance greater than said predetermined value; and switch means for causing said voltage applied to said second terminal to be greater than said reference voltage when said switch means is activated;

wherein said switch means in parallel across said resistor means, said switch means including a switch and a bias resistor coupled in series, wherein activation of said switch causes said bias resistor to be electrically isolated from said smoke detector unit.

4. A smoke detector unit including testing apparatus, said smoke detector unit comprising:

a first voltage regulator providing a first regulated voltage;

a sensing component responsive to products of combustion, a sensing component resistance decreasing when products of combustion are detected by said sensing component;

resistor means coupled i series with said sensing component, said resistor means having a resistor terminal, said resistor means and said sensing component coupled to said first voltage regulator;

a second voltage regulator providing a reference voltage;

comparator means for providing an alarm signal at an output terminal of said comparator means when a voltage applied to a second terminal of said comparator means is greater than a detector voltage applied to a first terminal of said comparator means, said reference voltage being applied to said first terminal, said second terminal of said comparator means being coupled to said resistor terminal, wherein said detector voltage applied to said second terminal is less than said reference voltage when products of combustion detected by said sensing component result in a sensing component resistance less than a predetermined value and wherein said detector voltage applied to said second terminal is greater than said reference voltage when products of combustion detected by said sensing component result in a sensing component resistance greater than said predetermined value; and switch means for causing said voltage applied to said second terminal to be greater than said reference voltage when said switch means is activated;

wherein said switch means includes a bias resistor coupled in series with said sensing component and said resistor means, said switch means including a switch coupled in parallel with aid bias resistor, wherein activation of said switch means provides a short circuit across said resistor.

5. A smoke detector unit including testing apparatus, said smoke detector unit comprising;

a first voltage regulator providing a first regulated voltage;

a sensing component responsive to products of combustion, a sensing component resistance decreasing when products of combustion are detected by said sensing component;

resistor means coupled in series with said sensing component, said resistor means having a resistor terminal, said resistor means and said sensing component coupled to said first voltage regulator;

a second voltage regulator providing a reference voltage;

comparator means for providing an alarm signal at an output terminal of said comparator means when a voltage applied to a second terminal of said comparator means is greater than a detector voltage applied to a first terminal of said comparator means, said reference voltage being applied to said first terminal, said second terminal of said comparator means being coupled to said resistor terminal, wherein said detector voltage applied to said second terminal is less than said reference voltage when products of combustion detected by said sensing component result in a sensing component resistance less than a predetermined value and wherein said detector voltage applied to said second terminal is greater than said reference voltage when products of combustion detected by said sensing component result in a sensing component resistance greater than said predetermined value; and switch means for causing said voltage applied to said second terminal to be greater than said reference voltage when said switch means is activated;

wherein said second voltage regulator includes a voltage dividing network, said reference voltage being determined by said voltage dividing circuit, said switch means including a switch and a first resistor, said said switch and said first resistor being coupled in parallel across a resistor of said voltage dividing network, wherein activation of said switch causes said reference voltage applied to said first comparator terminal to decrease.

6. A smoke detector unit including testing apparatus, said smoke detector unit comprising:

a first voltage regulator providing a first regulated voltage;

a sensing component responsive to products of combustion, a sensing component resistance decreasing when products of combustion are detected by said sensing component;

resistor means coupled in series with said sensing component, said resistor means having a resistor terminal, said resistor means and said sensing component coupled to said first voltage regulator;

a second voltage regulator providing a reference voltage;

comparator means for providing an alarm signal at an output terminal of said comparator means when a voltage applied to a second terminal of said comparator means is greater than a detector voltage applied to a first terminal of said comparator means, said reference voltage being applied to said first terminal, said second terminal of said comparator means being coupled to said resistor terminal, wherein said detector voltage applied to said second terminal is less than said reference voltage when products of combustion detected by said sensing component result in a sensing component resistance less than a predetermined value and wherein said detector voltage applied to said second terminal is greater than said reference voltage when products of combustion detected by said sensing component result in a sensing component resistance greater than said predetermined value; and switch means for causing said voltage applied to said second terminal to be greater than said reference voltage when said switch mans is activated;

wherein said sensing component includes a heating element, said heating element coupled in parallel with said sensing component and said resistor means, said switch means coupled between said second voltage regulator and said sensing component, said switch means including a switch coupled in parallel with a bias resistor, activation of said switch means causing a short circuit across said bias resistor.

7. A smoke detector unit including testing apparatus, said smoke detector unit comprising:

a first voltage regulator providing a first regulated voltage;

a sensing component responsive to products of combustion, a sensing component resistance decreasing when products of combustion are detected by said sensing component;

resistor means coupled in series with said sensing component, said said resistor means having a resistor terminal, said resistor means and said sensing component coupled to said first voltage regulator;

a second voltage regulator providing a reference voltage;

comparator means for providing an alarm signal at an output terminal of said comparator means when a voltage applied to a second terminal of said comparator means is greater than a detector voltage applied to a first terminal of said comparator means, said reference voltage being applied to said first terminal, said second terminal of said comparator means being coupled to said resistor terminal, wherein said detector voltage applied to said second terminal is less than said reference voltage when products of combustion detected by said sensing component result in a sensing component resistance less than a predetermined value and wherein said detector voltage applied to said second terminal is greater than said reference voltage when products of combustion detected by said sensing component result in a sensing component resistance greater than said predetermined value; and switch means for causing said voltage applied to said second terminal to be greater than said reference voltage when said switch means is activated;

wherein said second voltage regulator includes a resistor dividing network for determining said reference voltage, wherein said switch means includes a switch coupled to a resistor in said resistor dividing network, activating said switch means causing a resistance a said resistor dividing network to be changed thereby altering said reference voltage.

8. A smoke detector unit including testing apparatus, said smoke detector unit comprising:

a first voltage regulator providing a first regulated voltage;

a sensing component responsive to products of combustion, a sensing component resistance decreasing when products of combustion are detected by said sensing component;

resistor means coupled in series with said sensing component, said said resistor means having a resistor terminal, said resistor means and said sensing component coupled to said first voltage regulator;

a second voltage regulator providing a reference voltage;

comparator means for providing an alarm signal at an output terminal of said comparator means when a voltage applied to a second terminal of said comparator means is greater than a detector voltage applied to a first terminal of said comparator means, said reference voltage being applied to said first terminal, said second terminal of said comparator means being coupled to said resistor terminal, wherein said detector voltage applied to said second terminal is less than said reference voltage when products of combustion detected by said sensing component result in a sensing component resistance less than a predetermined value and wherein said detector voltage applied to said second terminal is greater than said reference voltage when products of combustion detected by said sensing component result in a sensing component resistance greater than said predetermined value;

switch means for causing said voltage applied to said second terminal to be greater than said reference voltage when said switch means is activated;

a second comparator unit, said second comparator unit having a second terminal coupled to said resistor terminal; and resistor dividing means coupled to said first voltage regulator circuit for providing a second reference voltage to a first input terminal of said second comparator means, wherein said voltage applied to said second comparator second terminal is less than said second reference voltage, said second comparator providing a second alarm signal upon failure of said sensing component.

9. A smoke detector unit including testing apparatus, said smoke detector unit comprising:

a first voltage regulator providing a first regulated voltage;

a sensing component responsive to products of combustion, a sensing component resistance decreasing when products of combustion are detected by said sensing component;

resistor means couple din series with said sensing component, said said resistor means having a resistor terminal, said resistor means and said sensing component coupled to said first voltage regulator;

a second voltage regulator providing a reference voltage;

comparator means for providing an alarm signal at an output terminal of said comparator means when a voltage applied to a second terminal of said comparator means is greater than a detector voltage applied to a first terminal of said comparator means, said reference voltage being applied to said first terminal, said second terminal of said comparator means being coupled to said resistor terminal, wherein said detector voltage applied to said second terminal is less than said reference voltage when products of combustion detected by said sensing component result in a sensing component resistance less than a predetermined value and wherein said detector voltage applied to said second terminal is greater than said reference voltage when products of combustion detected by said sensing component result in a sensing component resistance greater than said predetermined value; and switch means for causing said voltage applied to said second terminal to be greater than said reference voltage when said switch means is activated;

wherein said resistor means is a rheostat, said resistor terminal being a variable terminal of said rheostat.

10. A smoke detector unit and associated test circuits, said smoke detector unit comprising:

a sensing means for detecting products of combustion, wherein detection of said products of combustion causes a detection voltage applied to a sensing means voltage terminal to change;

reference means for providing a reference voltage;

comparison means responsive to said reference voltage and to said detection voltage for providing an alarm signal when said detection voltage is greater than said reference voltage;

a voltage supply for applying a sensing means voltage to said sensing means, wherein said voltage supply has plurality of supply terminals, each supply terminal having a different voltage applied thereto; and switch means coupled to said plurality of supply terminals for controlling a magnitude of sensing means voltage, wherein activation of a preselected position of said witch means results in a detection voltage that is greater than said reference voltage.

11. The smoke detector unit of claim 10 wherein said voltages of said supply voltages are alternating voltages.

12. A smoke detector unit for detecting a presence of products of combustion, said smoke detector unit comprising:

sensing means for providing a resistance that is a function of detected products of combustion, wherein said sensing means includes a voltage terminal for determining a voltage at a preselected point in said sensing means;

a first voltage regulator for applying a regulated voltage to said sensing means;

reference means for providing a reference voltage;

comparison means for determining when said resistance changes by a preselected amount, said comparison means comparing a first voltage determined by said voltage terminal with said reference voltage, said comparison means providing an alarm signal when said first voltage is greater than said reference voltage; and switch means for changing a one of said first voltage and said reference voltage in response to activation of said switch means;

wherein said sensing means includes a resistor and a sensing element, said resistor and said sensing element being coupled in series, said reference voltage being determined by a second voltage regulator and a voltage dividing network, wherein said switch means includes a switch and a resistor coupled in series, said switch means being couple din parallel with a resistor of said voltage dividing network.

13. A smoke detector unit for detecting a presence of products of combustion, said smoke detector unit comprising:

sensing means for providing a resistance that is a function of detected products of combustion, wherein said sensing means includes a voltage terminal for determining a voltage at a preselected point in said sensing means;

a first voltage regulator for applying a regulated voltage to said sensing means;

reference means for providing a reference voltage;

comparison means for determining when said resistance changes by a preselected amount, said comparison means comparing a first voltage determined by said voltage terminal with said reference voltage, said comparison means providing an alarm signal when said first voltage is greater than said reference voltage; and switch means for changing a one of said first voltage and said reference voltage in response to activation of said switch means;

wherein said sensing means includes a sensing element and a resistor coupled in series, wherein said switch means is coupled in parallel with said resistor, said switch means including a switch and a bias resistor coupled in series.

14. A smoke detector unit for detecting a presence of products of combustion, said smoke detector unit comprising:

sensing means for providing a resistance that is a function of detected products of combustion, wherein said sensing means includes a voltage terminal for determining a voltage at a preselected point in said sensing means;

a first voltage regulator for applying a regulated voltage to said sensing means;

reference means for providing a reference voltage;

comparison means for determining when said resistance changes by a preselected amount, said comparison means comparing a first voltage determined by said voltage terminal with said reference voltage, said comparison means providing an alarm signal when said first voltage is greater than said reference voltage; and switch means for changing a one of said first voltage and said reference voltage in response to activation of said switch means;

wherein said sensing means includes a sensing element and a resistor, said switch means being coupled in series with said sensing element, said witch means including a switch and a bias resistor coupled in parallel.

15. A smoke detector unit for detecting a presence of products of combustion, said smoke detector unit comprising:

sensing means for providing a resistance that is a function of detected products of combustion, wherein said sensing means includes a voltage terminal for determining a voltage at a preselected point in said sensing means;

a first voltage regulator for applying a regulated voltage to said sensing means;

reference means for providing a reference voltage;

comparison mans for determining when said resistance changes by a preselected amount, said comparison means comparing a first voltage determined by said voltage terminal with said reference voltage, said comparison means providing an alarm signal when said first voltage is greater than said reference voltage; and switch means for changing a one of said first voltage and said reference voltage in response to activation of said switch means;

wherein said sensing means includes a sensing element and a resistor coupled in series, said sensing element including a heating element, wherein said switch means and said heating element are couple din series and coupled to said first voltage regulator, said switch means including a switch and a bias resistor coupled in parallel.

16. A smoke detector unit for detecting a presence of products of combustion, said smoke detector unit comprising:

sensing means for providing a resistance that is a function of detected products of combustion, wherein said sensing means includes a voltage terminal for determining a voltage at a preselected point in said sensing means;

a first voltage regulator for applying a regulated voltage to said sensing means;

reference means for providing a reference voltage;

comparison means for determining when said resistance changes by a preselected amount, said comparison means comparing a first voltage determined by said voltage terminal with said reference voltage, said comparison means providing an alarm signal when said first voltage is greater than said reference voltage; and switch means for changing a one of said first voltage and said reference voltage in response to activation of said switch means;

wherein said sensing means includes a sensing element and a resistor coupled in series, said sensing element including a heating element, said switch means being coupled to said first voltage regulator, said switch means being coupled in in series with said heating element and being coupled in series with said heating element, said switch means including a switch and a bias resistor coupled in parallel.

17. A smoke detector unit for detecting a presence of products of combustion, said smoke detector unit comprising:

sensing means for providing a resistance that is a function of detected products of combustion, wherein said sensing means includes a voltage terminal for determining a voltage at a preselected point in said sensing means;

a first voltage regulator for applying a regulated voltage to said sensing means;

reference means for providing a reference voltage;

comparison means for determining when said resistance changes by a preselected amount, said comparison means comparing a first voltage determined by said voltage terminal with said reference voltage, said comparison means providing an alarm signal when said first voltage is greater than said reference voltage; and switch means for changing a one of said first voltage and said reference voltage in response to activation of said switch means;

wherein said first voltage regulator includes a resistor dividing network for determining said regulated voltage, said switch means being coupled to at least one resistor of said voltage dividing network, said switch means including a bias resistor and a switch, activation of said switch means changing said regulated voltage.

18. A smoke detector unit for detecting a presence of products of combustion, said smoke detector unit comprising;

sensing means for providing a resistance that is a function of detected products of combustion, wherein said sensing means includes a voltage terminal for determining a voltage at a preselected point in said sensing means;

a first voltage regulator for applying a regulated voltage to said sensing means;

reference means for providing a reference voltage;

comparison means for determining when said resistance changes by a preselected amount, said comparison means comparing a first voltage determined by said voltage terminal with said reference voltage, said comparison means providing an alarm signal when said first voltage is greater than said reference voltage;

switch means for changing a one of said first voltage and said reference voltage in response to activation of said switch means; and wherein a second reference voltage is provided by said reference means;

second comparator means, said second comparator means having said second reference voltage connected to a first terminal of said second comparison means, said second comparison means having a second terminal coupled to said voltage terminal, wherein a malfunction of said sensing means results in a decrease in said voltage terminal voltage, a second alarm signal being generated at an output terminal of said second comparator means in response to said voltage terminal voltage decrease.

* * * * *

UNITED STATES PATENT AND TRADEMARK OFFICE

CERTIFICATE OF CORRECTION

PATENT NO. : 5,121,101

DATED : June 9, 1992

INVENTOR(S) : Peter J. Jakubowski and Randolf D. Pearce

It is certified that error appears in the above-indentified patent and that said Letters Patent is hereby corrected as shown below:

Col. 2, line 4. After "of", add --combustion--.

Col. 2, line 4. After "detection", add --of--.

Col. 3, line 59. After "Fig.", add --1--.

Col. 4, line 2. After "terminal", add -of--.

Col. 5, line 27. After "U1", insert --and the common terminal--.

Col. 6, line 9. Delete "the increase" and insert --the increased--.

Col. 6, line 42. Delete "circuit" and insert --circuits--.

Col. 7, line 20. Delete "i" and insert --in--.

Col. 8, line 9. After "means", insert --is--.

Col. 8, line 23. Delete "i" and insert --in--.

Col. 8, line 54. Delete "aid" and insert --said--.

UNITED STATES PATENT AND TRADEMARK OFFICE

CERTIFICATE OF CORRECTION

PATENT NO. : 5,121,101

DATED : June 9, 1992

INVENTOR(S) : Peter J. Jakubowski and Randolf D. Pearce

It is certified that error appears in the above-indentified patent and that said Letters Patent is hereby corrected as shown below:

Col. 10, line 3. Delete "mans" and insert --means--.

Col. 10, line 54. Delete "a said" and insert --of said--.

Col. 11, line 43. Delete "couple din" and insert --coupled in--.

Col. 12, line 25. Delete "witch" and insert --switch--.

Col. 12, line 57. Delete "couple din" and insert --coupled in--.

Col. 13, line 42. Delete "witch" and insert --switch--.

Col. 13, line 56. Delete "mans" and insert --means--.

Col. 14, lines 1 and 2. Delete "couple din" and insert --coupled in--.

UNITED STATES PATENT AND TRADEMARK OFFICE

CERTIFICATE OF CORRECTION

PATENT NO. : 5,121,101

DATED : June 9, 1992

INVENTOR(S) : Peter J. Jakubowski and Randolf D. Pearce

It is certified that error appears in the above-indentified patent and that said Letters Patent is hereby corrected as shown below:

In Fig. 3, delete the connection between switch SW2 and the heater element of SENSOR S1 and insert a connection between switch SW2 and the terminal of SENSOR S1 to which the rheostat R1 is connected.

Signed and Sealed this

Nineteenth Day of October, 1999

*Attest:*

*Attesting Officer*

Q. TODD DICKINSON

*Acting Commissioner of Patents and Trademarks*